United States Patent [19]

Bayard

[11] 4,053,969

[45] Oct. 18, 1977

[54] HEAT EXCHANGER

[75] Inventor: Gaston Bayard, Toulouse, France

[73] Assignee: Societe Anonyme Microturbo, Toulouse Cedex, France

[21] Appl. No.: 664,973

[22] Filed: Mar. 8, 1976

[30] Foreign Application Priority Data

Mar. 10, 1975 France ..... 75.07463

[51] Int. Cl.[2] ..... B23P 15/26

[52] U.S. Cl. ..... 29/157.3 D; 29/467; 228/183; 228/181; 228/256

[58] Field of Search ..... 29/157.3 D, 157.3 R, 29/433, 467, 464, 202 R; 165/166; 228/183, 181, 256, 261, 19

[56] References Cited

U.S. PATENT DOCUMENTS

| | | | |
|---|---|---|---|
| 2,794,243 | 6/1957 | Schweller | 228/183 |
| 2,960,197 | 11/1960 | Langhans | 228/181 |
| 2,961,222 | 11/1960 | Butt | 228/183 |
| 3,071,187 | 1/1963 | Fairbanks | 29/157.3 D |
| 3,119,418 | 1/1964 | Rayniak | 29/467 |
| 3,473,210 | 10/1969 | Klank | 29/157.3 R |
| 3,489,448 | 1/1970 | Nagara et al. | 228/183 |
| 3,537,165 | 11/1970 | Paddock et al. | 29/157.3 D |
| 3,894,580 | 7/1975 | Chartet | 29/464 |
| 3,941,293 | 3/1976 | Chartet | 29/157.3 R |

FOREIGN PATENT DOCUMENTS

| | | | |
|---|---|---|---|
| 658,222 | 2/1963 | Canada | 29/157.3 R |
| 10,646 | 11/1967 | Japan | 29/157.3 R |
| 915,750 | 1/1963 | United Kingdom | 29/157.3 R |

OTHER PUBLICATIONS

Brazed Aluminum Heat Exchangers, in Modern Metals, vol. VII, No. 9, Oct., 1951, Modern Metals Publishing Co., Chicago, Ill., pp. 25-28.

*Primary Examiner*—C.W. Lanham
*Assistant Examiner*—Daniel C. Crane
*Attorney, Agent, or Firm*—Keil, Thompson & Shurtleff

[57] ABSTRACT

A process and apparatus are provided for assembling a heat exchanger comprising a stack of metallic elements, more particularly a heat exchanger of the cross-flow type.

7 Claims, 10 Drawing Figures

HEAT EXCHANGER

The invention relates to a process of assembling a unit comprising a stack of metallic elements such as corrugated sheets, thin intermediate plates and side rods.

It is known that heat exchangers, particularly compact exchangers of the cross-flow type, consist of a stack of corrugated sheets, thin intermediate plates and border or side rods which form and control two systems of fluid passage, primary and secondary; these systems must be tight, on one hand, with respect to each other, and on the other hand, each with respect to an exterior inactive medium. The stack is placed between two thick base plates to which are soldered sheet iron uniting and aligning elements.

Such heat exchangers are usually assembled by depositing a brazing composition on two surfaces of each of the thin plates, by soldering on the lower base plate fine rods serving as guides, by stacking the thin plates, the corrugated sheets, and the side rods on the lower base plate, the thin plates and side rods being provided with holes into which are placed guide rods for positioning the elements, the upper base plate then being put into position and the assembly centered by steel wires fastened to rings soldered on the base plates.

The exchanger block thus prepared is then placed in a brazing oven, pressure being applied on the block by means of a weight, a screw jacket or other suitable means.

Once the brazing operation is completed the uniting and aligning sheet metal elements are soldered or welded onto the assembly.

The foregoing process has several disadvantages which result in the production of exchangers of mediocre quality which are not satisfactory in normal use over a long period of time.

In the first place, the final shape of the exchanger obtained is not very exact; this defect is brought about essentially by the process of stacking the elements; the guide rods or stems are necessarily very fine for passing through the holes or perforations in the thin plates and side rods and are subject to deformation which assures little guiding precision. Moreover, the manner of arranging the assembly with steel wires does not guarantee absolute stability of the elements with respect to each other during the diverse manipulations and in the course of the brazing operation.

Furthermore, the perforations provided in the thin plates and rods are equally a source of water tightness defects if the brazing in the adjacent area is not perfect.

Additionally, the soldering of the uniting and aligning sheet metal is effected after brazing which results in the formation of cracks so that it is necessary to effect a second brazing operation after the exchanger leaves the brazing oven, thereby increasing the amount of work required in the process while producing an exchanger which is less than perfect.

Also, the deposit of the brazing composition on the surfaces of the thin plates creates a variable thickness between the elements which is multiplied in all of the stages of the exchangers and does not assure a good meeting of the surfaces for brazing before the brazing operation. The brazing thus obtained contains local defects which produce mediocre strength of the elements and defective water tightness.

Imprecision of the shape of the exchangers results also from excess thickness, notably in the vertical direction. The latter presents an elevation disparity because of the inevitable differences in thickness of deposits applied on the surfaces by brazing.

The present invention provides a remedy for the serious and numerous defects of the fabrication process previously described.

An object of this invention is to permit the manufacture of a satisfactory exchanger with a precise shape.

Another object is to guarantee after brazing a rigorous water tightness of the elements as well as an excellent mechanical structure.

Another object of the invention is to reduce the cost of carrying out the process.

Other objects and advantages of the invention will appear from the following description in conjunction with the accompanying drawings in which.

Figure 4:
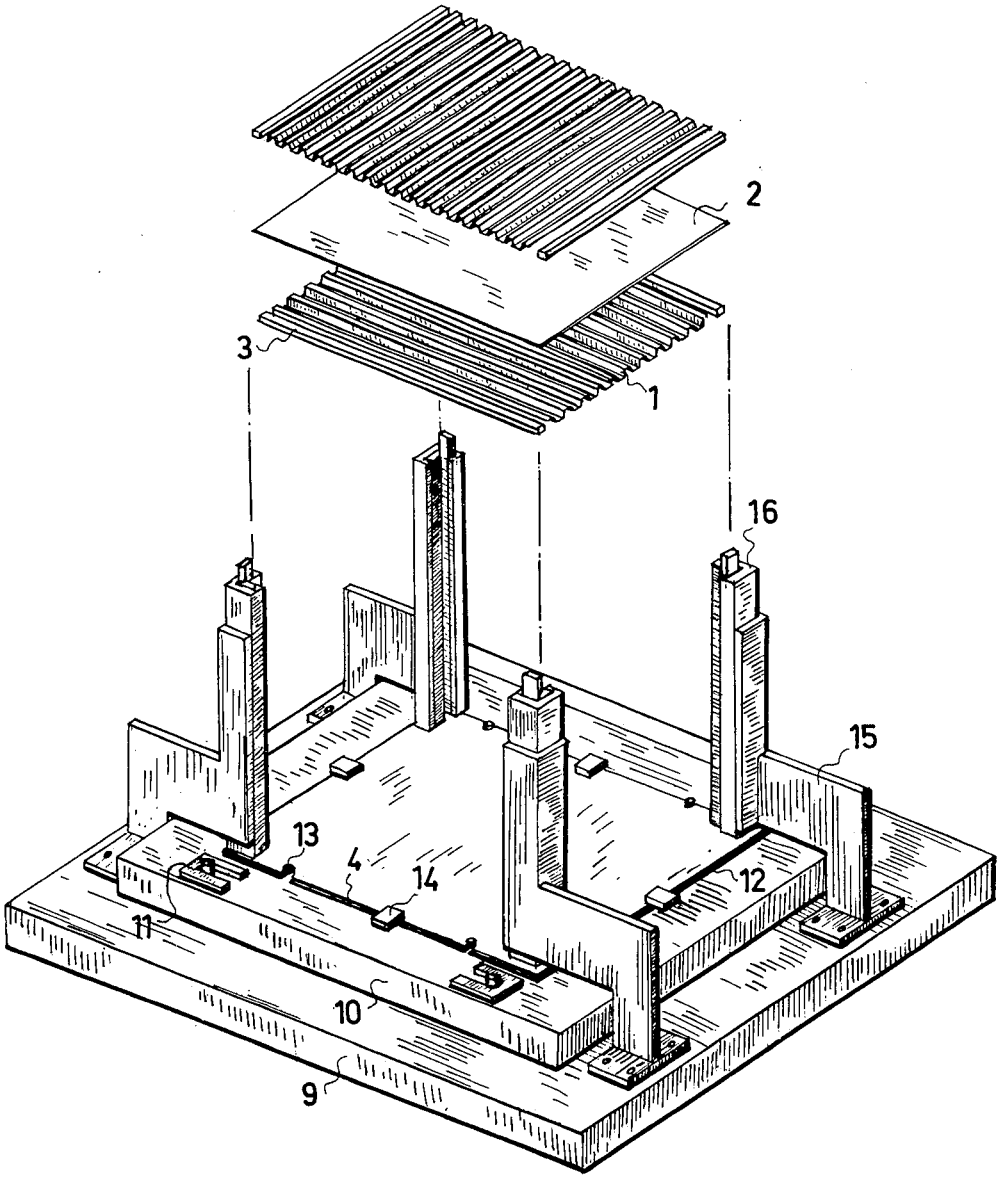
Figure 5B:
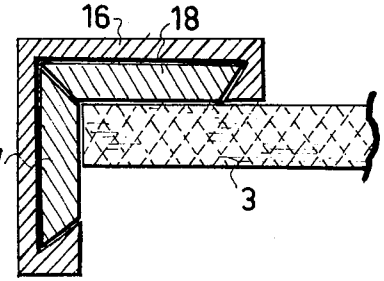
Figure 5A:
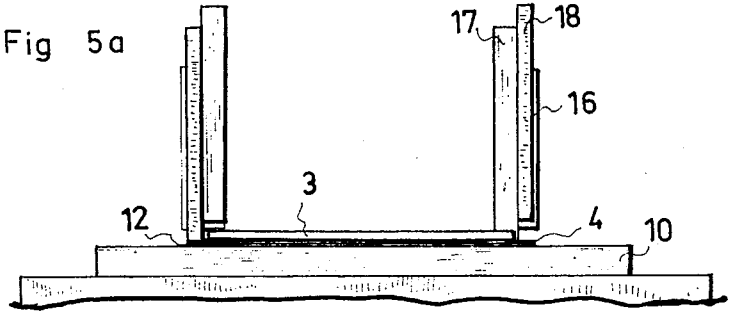

FIG. 5*a* is a side elevational view of a portion of the apparatus shown in FIG. 4;

FIG. 5*b* is a partial detailed cross sectional view of a portion of the apparatus shown in FIG. 5*a;*

Figure 7:
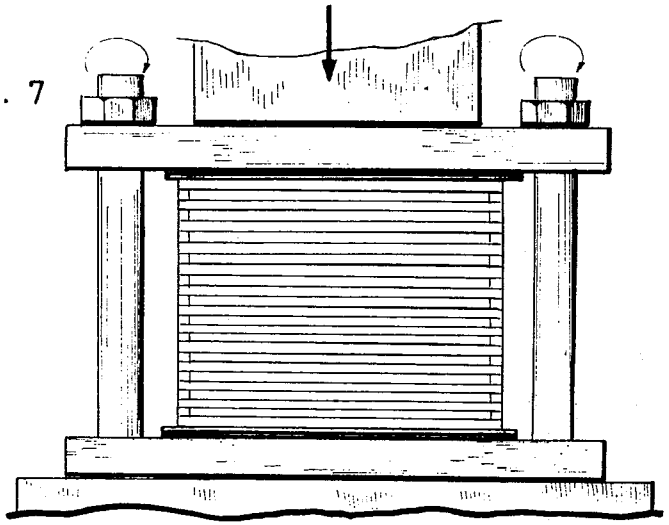
Figure 6:
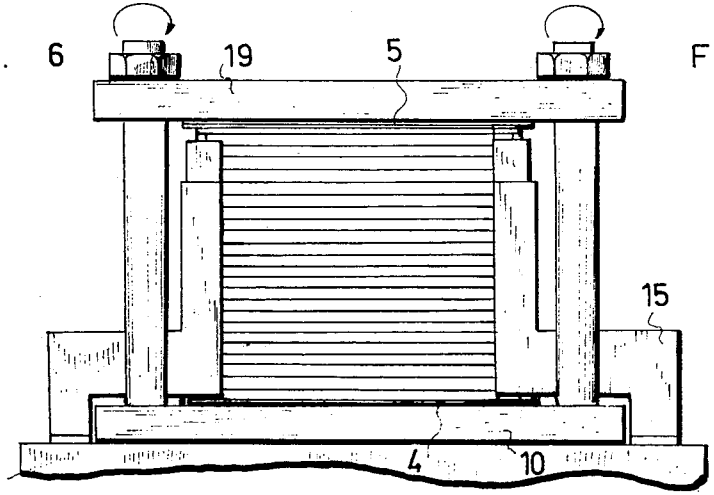
Figure 8:
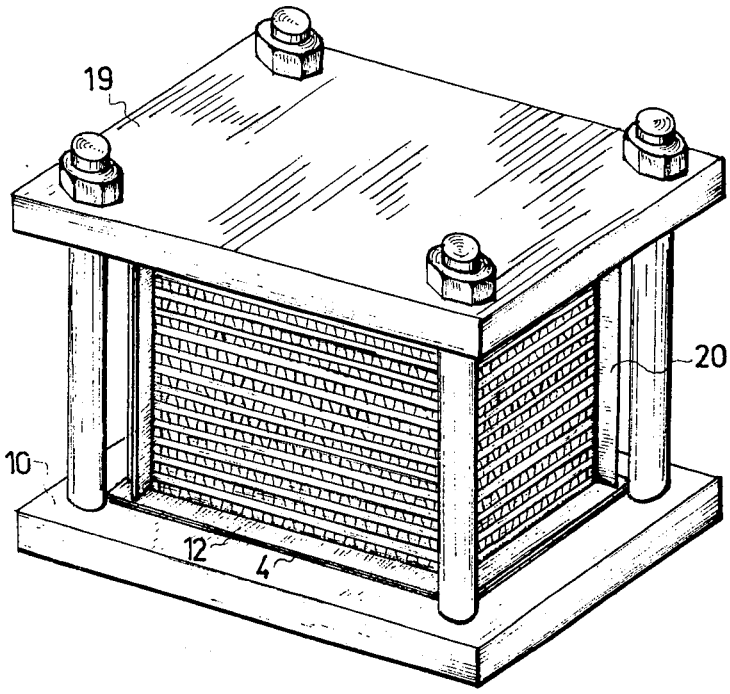
Figure 9:
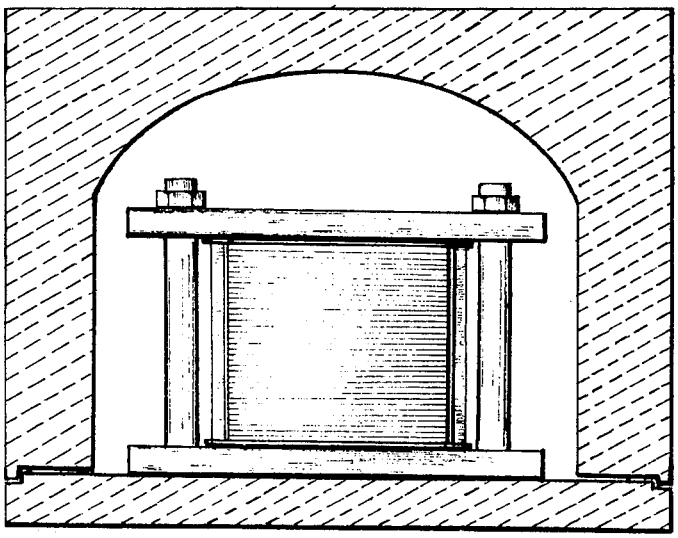

FIG. 6 is a side elevational view of the apparatus used for assembling the heat exchanger;

FIG. 7 is a side elevational view illustrating the application of pressure to the upper press plate of the press apparatus shown in FIG. 6;

FIG. 8 is a perspective view of the heat exchanger stack assembled in the press; and FIG. 9 is a side elevational view of the assembly shown in FIG. 8 in a brazing oven.

Generally speaking, the invention contemplates a process which is precisely reproducible for fabricating units of a type of heat exchanger which comprises a stack of metallic elements such as corrugated sheets, intermediate thin plates, and side rods, these elements presenting contacting surfaces on thin faces, and, recessed surfaces between them such that base and lateral faces of the grooves of the corrugated sheets or lateral faces of the side rods are united and equipped on their sides with uniting and aligning sheet metal.

The process of the invention comprises:

a. placing a brazing composition on the elements to be brazed, b. stacking the elements in an appropriate fashion on a base plate with which removable guide members are associated, these guide members being rigid and spaced apart to constitute a guiding form into which the elements are positioned, resting their sides against said form, c. placing an upper plate on the stack and pressing the upper and lower plates together by means of connecting columns provided with tightening means, d. withdrawing the guide members and applying a tightening pressure on the plates, the space between the upper and lower plates being reduced to a predetermined size, e. fixing the tightening means, so as to provide pressure on the plates in order to obtain a compact transportable assembly which maintains a constant space between the plates, f. soldering or welding uniting and aligning sheet metal positioning members on the sides of the assembly, g. placing the aforesaid compact assembly into a brazing oven under conditions adapted to braze the elements of the stack, and h. releasing the tightening means and withdrawing the plates and connecting rods.

By this mode of assembly of the elements and their firm tightening between the plates, a compact assembled structure is obtained having a precise shape which even before the brazing operation can be handled without risk.

These steps permit soldering or welding the uniting and aligning sheets before the brazing operation, so that the soldering can be carried out without taking particular precautions and without affecting good quality of tightness and waterproofness and, of course, without effect on the brazing, a factor not heretofore accomplished. Soldering is not greatly affected by the later brazing because the temperatures of brazing are lower than those used during the soldering.

The brazing composition placed on the elements must be present in the form of layers interposed between them; it must also be capable of being applied in the form of a fine deposit of a powdered brazing composition containing a binder having the proper qualities of cohesion and adherence.

In the latter case the deposit is preferably applied on recessed surfaces of the elements; for example, the deposit may be applied to the corrugated sheets: first by projecting the brazing composition on the assembly of element surfaces, then, eliminating, for example, by brushing, the product deposited on the contact surfaces of said elements. In this manner of practicing the invention as described above, the contact surfaces which are to be brought together are devoid of all excess thickness of the kind that might interfere with perfect contact; preferably the tightened pressure applied is adapted to restore the spacing of the plates to a size equal to the sum of the normal thicknesses of the stacked elements. It can easily be demonstrated that this is not difficult due to the absence of the excess thickness between the contacting surfaces. Thus, a precise size is obtained in the vertical direction of the stack and a tight and resistant brazing obtained on account of the closeness of the surfaces.

To make a unit in a polygonal form the aforesaid guiding members are advantageously in the form of a square adapted to guide the elements at a right angle on the short portions of their corresponding sides.

According to a complementary characteristic of the process, when the mounting is begun there is interposed between each base and the stack a pressure plate on the surface of which is applied a layer of a brazing composition inhibitor which prevents reaction of the brazing composition at the place of contact. This eliminates all risk of brazing between the unit and the base plates between which it is disposed.

Other characteristics and advantages of the invention will appear from the following description in conjunction with the drawings which illustrate by way of example but not by way of limitation a method of practicing the invention for the manufacture of a heat exchanger of the cross-flow type.

In the drawings, FIGS. 1, 2, 3, 4, 5*a*, 5*b*, 6, 7, 8 and 9 schematically show the steps of the process and illustrate the apparatus employed.

Figure 1:
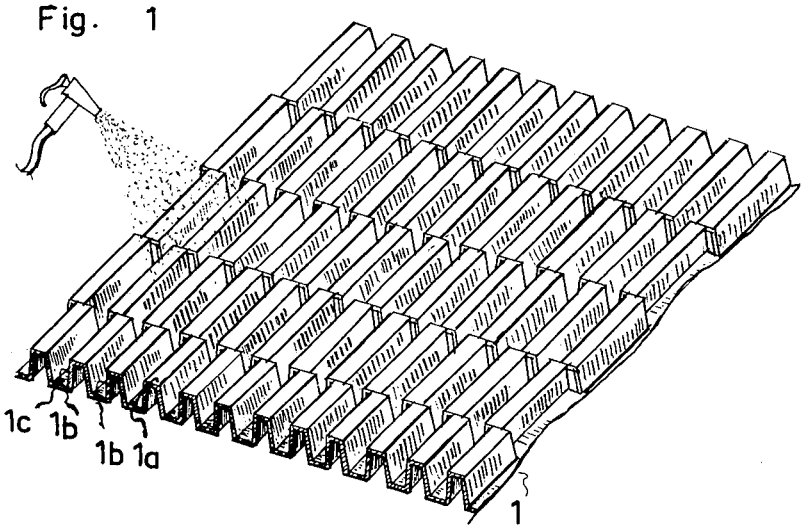
FIG. 1 is a perspective view illustrating corrugated metal sheets of the type used in making a heat exchanger in accordance with the invention and showing the manner in which a brazing material is applied to the recesses of the corrugations.
Figure 2:
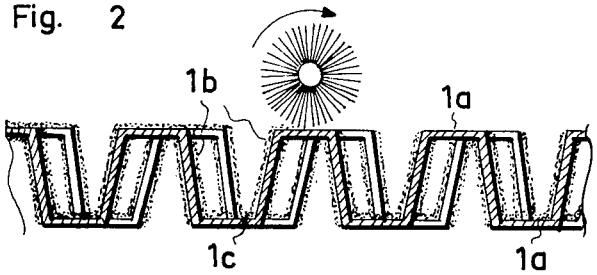
FIG. 2 is a side elevational view partly in section with parts broken away of a portion of the corrugated sheets shown in FIG. 1 illustrating the manner in which the brazing material can be removed from the contacting surfaces of the corrugations.
Figure 3:
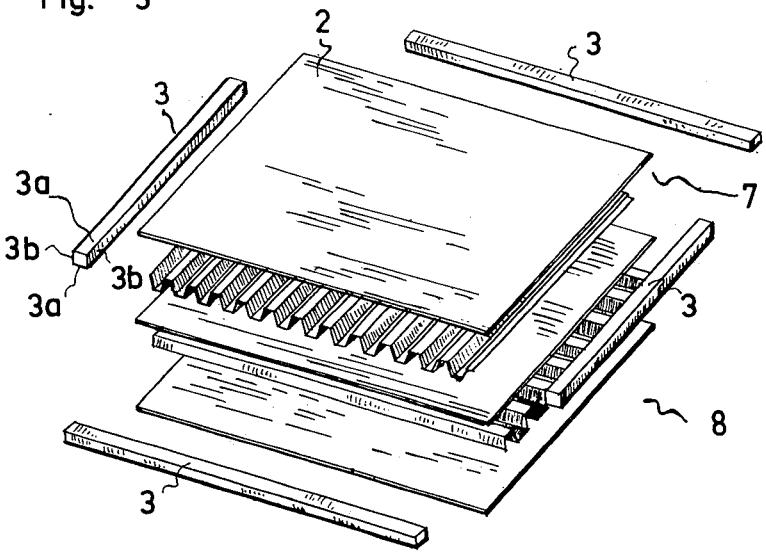
FIG. 3 is an exploded view in perspective of the various elements employed in making a heat exchanger in accordance with the invention.

The type of exchanger shown in the example comprises:

a plurality of corrugated sheets, as represented by 1 in the figures which present contacting surfaces 1*a* and recessed surfaces having sides 1*b* and bottom 1*c* in the form of grooves; for example, in FIG. 1 the corrugations of each sheet comprise in the usual fashion longitudinal portions staggered transversely, some with respect to one another with frontal openings for increasing the division of fluid flow through the passageways;

a plurality of thin intermediate plates as shown at 2 in FIG. 3;

a plurality of side or edging rods 3, the same height as the corrugated sheet 1 and disposed between two opposing plates along the two sides longitudinally of a corrugated sheet, each rod presenting contact surfaces (faces 3*a*) to receive the thin plates and lateral faces 3*b* to contact the surfaces of said recesses;

two thick base plates which are shown at 4 and 5 in FIGS. 4 and 6;

sheet metal uniting and aligning members which are shown at 20 in FIG. 8;

After scraping the surfaces to remove all impurities, the corrugated sheets and side rods are subjected, by means of a spray device, to a spray of a brazing powder mixed with a binder, the mixture being a brazing composition (FIG. 1); the brazing composition is of a type which is adapted to be used for alloying the elements formed by brazing.

Brushing the contact surfaces (FIG. 2) is carried out to eliminate from the surfaces such as 1*a* all traces of the brazing composition; the deposit of the brazing composition is then limited to the recessed surfaces, i.e., lateral surfaces 1*b* and bottom 1*c* of the grooves of the corrugated sheet, and lateral surfaces 3*b* of the side rods.

FIG. 3 schematically illustrates the stacking process. The corrugated sheets are disposed in predetermined direction for certain layers, such as illustrated at 7, and in different directions (for example, at right angles) in other layers as illustrated at 8. The side rods which are disposed in each layer parallel to the corrugations form a border which defines two watertight systems, the one transversely with all of the corrugated sheets disposed in one direction and the other transversely with the corrugated sheets disposed in a direction at right angles.

The stacking of the elements is accomplished as shown in FIG. 4 on a mounting table 9 on which is centered and fixed a base plate 10 made of non-oxidizable steel and having a substantial thickness. The centering and fixing of the base are accomplished, for example, by pins inserted into holes in the table and the base plate and permitting adjustment by means of anchoring pieces as shown at 11.

On the base plate 10 are mounted first a pressure plate 12 whose faces are covered with a brazing inhibiting composition, then bottom plate 4 of the exchanger. This pressure plate and bottom plate of the same shape are first centered by pins introduced into the slots 13 arranged in the base plate at suitable places, then are fixed by means of anchoring members 14 on the base plate; the centering pins are then withdrawn.

After this operation, the feet such as 15 are fastened on the mounting table; each foot has a square angle opening such as 16, which is telescopic and comprises a retractable length which extends beyond the angle square. For example, two regulators 17 and 18 may slide in a groove of the square; the one is wedged in lower position by a removable pin in a manner so that it can descend to the bottom plate, the other is lowered into a higher position in a manner to pass beyond the square and assure guiding of the elements situated in higher stages of the stack.

The stacking operation begins by putting in place two rods 3 on the base plate; these rods are positioned in a precise manner in proximity to two sides of the plate by means of the angle square being placed in contact with them which assures a square alignment laterally and longitudinally as shown schematically in FIGS. 5*a* and 5*b*.

A corrugated sheet is then placed on the bottom plate between two side rods. It will be noted that the only surfaces coming in contact with the bottom plate are the contact surfaces without a brazing composition.

A thin intermediate plate 2 is then placed on the side rods and corrugated sheet already in place, this thin plate being guided by the square. The thin plate being without brazing composition, the surfaces are in direct contact without unevenness.

The stacking process is continued in this same fashion, the corrugated sheets and the side rods being positioned in one direction or the other according to the particular layer.

A pressure plate containing a brazing inhibiting composition is disposed on the surface 1*a* above the last corrugated sheet (FIG. 6) and an upper plate 19 similar to base plate 10 is placed over the pressure plate. The binding columns are then put in place between the two plates. These columns are engaged in openings in the base plate and held in place by means of pins and anchoring means. They are each provided at the one extremity with a head contacting the base plate (across the openings of the mounting table of larger diameter) and, at the other extremity, a threaded part on which is tightened a nut to secure the upper plate 19.

Removable bolts maintaining the high regulation of the squares are withdrawn so as to permit lowering; the nuts are then manually turned in order to provide a first tightening of the stack, which stabilizes the elements and permits withdrawal of the squares and transporting the elements without risk of deformation. However, the height of the stack remains greater than the final size at completion, which is equal to the sum of the normal thicknesses of all of the elements of the stack.

After withdrawing the squares, the assembly is placed in a press (FIG. 7) where a binding pressure which is approximately of the order of 50 atmospheres is applied on the plates until the exchanger is precisely fixed; a rigorous compactness is thus assured between the contacting elements and when the nuts are turned once more, the final shape of the stack is definitely obtained (FIG. 8) and this with an excellent precision.

The assembly is then placed in a conventional apparatus to permit soldering of the sheet iron uniting and aligning elements. For example, in FIG. 8 the latter are composed of the corners 20 soldered on the bottom plate and on the edges of the stack.

Before placing the assembly in the brazing oven, a brazing composition is sprayed on the different faces and on the soldered parts.

Rigorous compactness of the elements is conducive to excellent quality brazings which are perfectly water tight and assure good mechanical strength of the elements; no cracks are observed in proximity to the soldering. It will be understood that the conditions of the brazing operation are well known. The brazing may be effected in a hydrogen atmosphere; in the course of the operation the brazing composition diffuses from the recessed surfaces even to the surfaces of contact.

As shown in FIG. 5, the side rods are, advantageously, finely striated on their contact surfaces in a manner to facilitate diffusion of the brazing composition toward those faces in the course of the brazing operation.

After brazing and cooling, the nuts of the columns are removed and the base plate, upper plate and columns are withdrawn. The exchanger is complete and ready for use.

Of course, the invention is not necessarily limited to the example described, but contemplates a number of variations; moreover, the nature of the assembly may be different, the process being applicable to the fabrication of an analogous type functioning in a similar manner.

The invention is hereby claimed as follows:

1. A process for the manufacture of a heat exchanger unit having a stack of metallic elements such as corrugated sheets, thin interposed plates, and edging rods, these elements presenting contacting surfaces flush with their faces and in certain instances recessed surfaces, the unit being provided on its sides with connecting metal sheets, consisting essentially of a. forming a thin deposit of a brazing composition only on the recessed surface of said elements;

b. stacking said elements in an appropriate fashion on a lower press plate with which removable guide members are associated, these guide members being rigid and spaced apart to constitute a guiding form inside which said elements are positioned in a manner such that their edges are supported against said guide members, the edging rods coming to rest against at least two of said guide members to ensure the lateral and longitudinal guiding of said rods, c. placing an upper press plate on the stack and pressing the upper and lower press plates together by means of connecting tightening columns provided with tightening means in a manner such that said upper and lower press plates can later be removed, d. applying a limited tightening pressure on the press plates of (c) so as to stabilize the stack, e. removing the said guide members, and placing the entire stack under pressure, f. exerting on said press plates a pressure the value of which is such that the space between the two press plates will be reduced to a given dimension, g. locking the tightening means, then stopping the application of pressure on said press plates so as to obtain a compact stack which can be transported held together by said press plates which have a predetermined and constant distance between them, h. soldering or welding on the edge of the stack connecting and aligning sheets of metal, i. after said welding or soldering operation of (h), placing the whole assembly into a brazing oven, under conditions suitable to bring about the brazing of the contact surfaces of the elements of the stack, and j. unlocking the tightening means and removing said press plates and the tightening columns.

2. A process according to claim 1 wherein the deposit of brazing composition on the recessed surfaces is formed, first, by projecting the composition on these elements, then, secondly, by eliminating by brushing the composition on the contacting surface of said elements.

3. A process as claimed in claim 1 wherein the guide members are telescopic and comprise a predetermined retractable length, the tightening pressure on the lower plate and the upper plate is applied in two operations, the first consisting in applying tightening means through the said connecting columns to cause said lower plate and upper plate to be pressed together a distance less than their final spacing, the guide means to be retracted before this operation to permit the approachment of said lower plate and said upper plate, the second being effected after withdrawal of the guide means consisting in placing the assembly under pressure to exercise an elevated pressure to decrease the spacing of said lower plate and said upper plate to a predetermined exact position.

4. A process as claimed in claim 3, wherein the last mentioned pressure is adapted to space the lower plate and the upper plate a distance equal to the sum of the normal thicknesses of the stack elements.

5. A process as claimed in claim 1 wherein there is interposed between the lower plate and the upper plate and the stack a pressure plate on the faces of which is applied a layer of brazing inhibiting composition of such a nature as to prevent brazing action in the areas containing said composition.

6. A process as claimed in claim 1 wherein at the time the compact assembly is taken to the brazing oven, the brazing composition is applied on the different faces of the stack and on the soldering.

7. A process as claimed in claim 1 wherein the contacting faces of the edging rods are finely striated to facilitate diffusion of a brazing composition in the course of a brazing operation.

* * * * *